US006167636B1

(12) United States Patent
Kepplinger et al.

(10) Patent No.: US 6,167,636 B1
(45) Date of Patent: Jan. 2, 2001

(54) PROCESS FOR THERMALLY UTILIZING SPENT GRAINS

(75) Inventors: Leopold Werner Kepplinger, Leonding; Dieter Pelz, Graz; Gerald Zanker, St.Peter/Hart, all of (AT)

(73) Assignee: Brau-Union Österreich Aktiengesselschaft, Graz (AT)

( * ) Notice: Under 35 U.S.C. 154(b), the term of this patent shall be extended for 0 days.

(21) Appl. No.: 09/315,199

(22) Filed: May 19, 1999

Related U.S. Application Data

(63) Continuation of application No. PCT/AT97/00250, filed on Nov. 18, 1997.

(30) Foreign Application Priority Data

Nov. 20, 1996 (AT) ..... 2022/96

(51) Int. Cl.[7] ..... F26B 3/34

(52) U.S. Cl. ..... 34/246; 34/370; 34/378; 34/381; 34/397; 34/522; 426/231

(58) Field of Search ..... 34/246, 378, 363, 34/370, 373, 379, 380, 381, 386, 397, 522; 426/231, 233, 422, 467

(56) References Cited

U.S. PATENT DOCUMENTS 4,290,269 9/1981 Hedström et al. ..... 60/670
5,191,723 * 3/1993 Herzog ..... 34/136 X
5,433,019 * 7/1995 Fu et al. ..... 34/381
5,535,528 * 7/1996 Finkham ..... 34/378
5,637,336 * 6/1997 Kannenberg et al. ..... 34/370 X
6,000,144 * 12/1999 Bussman et al. ..... 34/378

FOREIGN PATENT DOCUMENTS 4443482 6/1996 (DE) .
0423400 4/1991 (EP) .

OTHER PUBLICATIONS

W. R. Meyer–Pittroff, "Die energetische Verwertung von Biertrebern", *Brauwelt*, No. 26, 1988, pp. 1156–1158 and 1179.

B. V. Potthast, "Biertreber sind besser als ihr Ruf!", *Brauwelt*, No. 39, 1991, pp. 1704, 1706 and 1707.

* cited by examiner

*Primary Examiner*—Stephen Gravini
(74) *Attorney, Agent, or Firm*—Ostrolenk, Faber, Gerb & Soffen, LLP

(57) ABSTRACT

In a process for thermally utilizing wet spent grains (1), the wet spent grains (1) are mechanically predried in a first drying stage (2), thermally dried in a further drying stage (4) and finally thermally utilized by burning or gasification.

Figure 1:
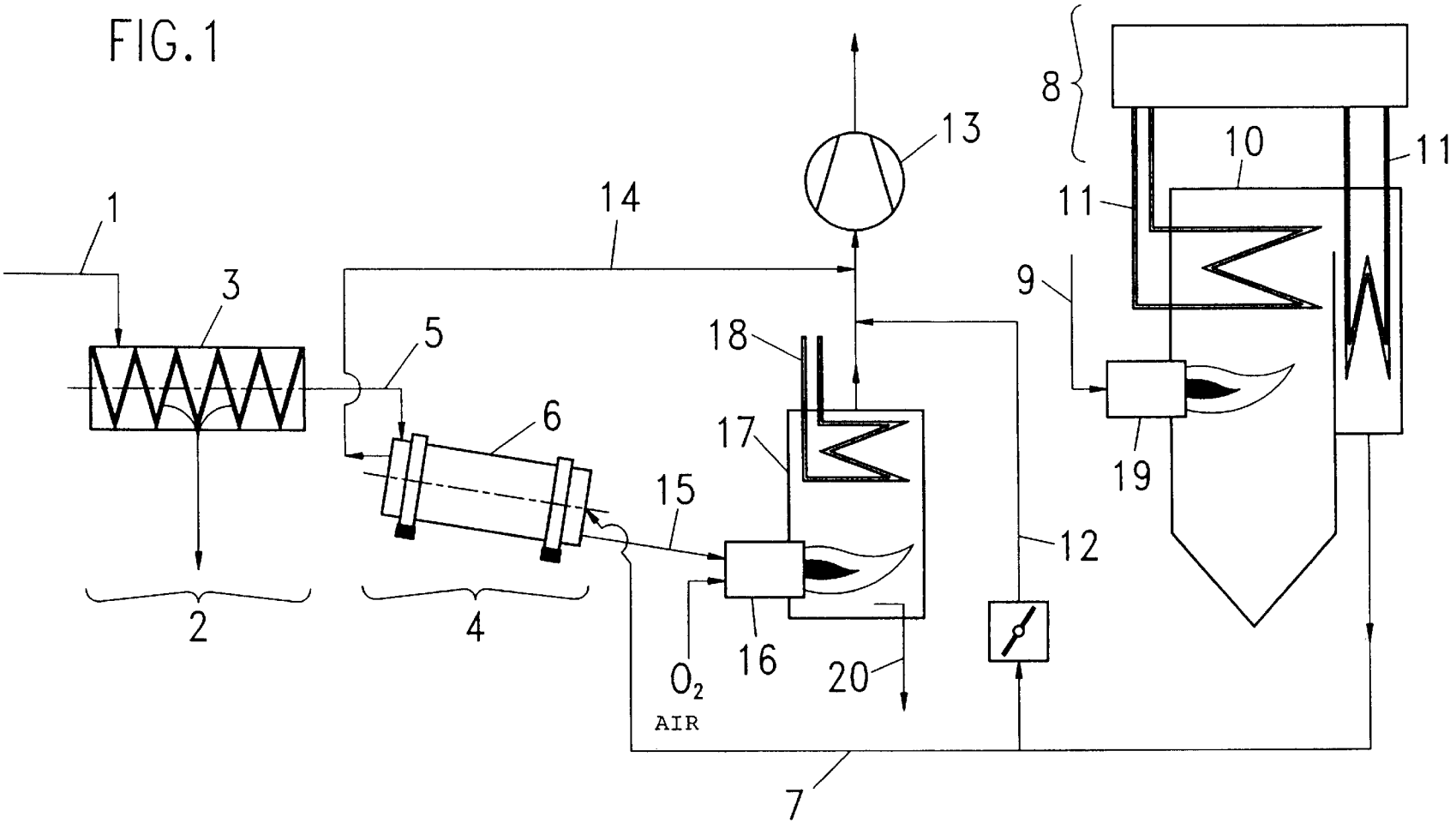

In order to be able to realize a process of this kind economically, the mechanically dehydrated spent grains (15) in the further drying stage (4) are heated by the aid of a smoke gas occurring within the energy system of a brewery.

25 Claims, 2 Drawing Sheets

PROCESS FOR THERMALLY UTILIZING SPENT GRAINS

CROSS-REFERENCE TO RELATED APPLICATIONS

This is a continuation application of International Application PCT/AT97/00250, with an International filing date of Nov. 18, 1997.

The invention relates to a process for thermally utilizing wet spent grains, wherein the wet spent grains are mechanically predried in a first drying stage, thermally dried in a further drying stage and finally thermally utilized by burning or gasification, as well as a plant for carrying out the process.

When producing beer, the wet spent grains, or brewing draff, which occur in large quantities, constitute a problem of disposal and utilization. About 20 kg of wet spent grains occur per hectoliter beer such that large-scale breweries have to dispose of, or utilize, hundreds of tons of spent grains per week.

Due to their composition, spent grains constitute a valuable fodder; it is, however, difficult to use the spent grains as a fodder in a cost-effective manner. The proper time for selling same as a fodder without problems is in winter—on the other hand, spent grains occur in larger quantities in summer than in winter. Moreover, spent grains cannot be stored without predrying. Drying is expensive, since only indirect drying is possible due to the demands set on fodder; which means poor heat transmission. Appropriate driers are expensive, involving high energy expenditures. In addition, the sale of spent grains as a fodder is going to become more and more difficult in the future because of the declining live-stock. The preservation of spent grains by fermentation again involves the disadvantage of high costs (Brauwelt No. 39 (1991), pp. 1704 to 1707).

The formation of a high-quality product for soil improvement speaks for the compostation of spent grains, yet the market is only small and production involves such high costs that it will not cover the costs, anyway.

Spent grains are also suitable for producing biogas, yet a biogas plant requires high investment costs.

An energetically practicable process for utilizing spent grains is direct burning. From the review "Brauwelt" No. 26 (1988), pp. 1156 to 1158, "Die energetische Verwertung von Biertrebern", a process for the recovery of energy from spent grains as described in the beginning is known. Spent grain combustion plants are, however, operating at a low effectiveness because of the necessarily intensive predrying (spent grains initially containing 75 to 80% by mass of water) and the relatively poor calorific value of spent grains.

The prerequisite for an energetically optimum utilization is the attainment of auto-combustibility, which will be obtained at a $H_2O$ content of about 55%.

The invention aims at avoiding these drawbacks and difficulties and has as its object to provide a process of the initially defined kind as well as a plant for carrying out said process, which enable the energetically optimum, i.e., possibly profit-making utilization of spent grains. Drying of the spent grains, in particular, is to be feasible by a possibly external energy expenditure to such an extent that the spent grains can be thermally utilized, i.e., burned or gasified without back-up heating.

In a process of the initially defined kind, this object is achieved in that the mechanically dehydrated spent grains, in the further drying stage, are heated by the aid of a smoke gas occurring in the energy system of a brewery. The smoke gas occurring in the production of beer is formed by the combustion of natural gas for the purpose of generating vapor.

Besides combustion, the gasification of predried spent grains is also feasible with a combustible gas occuring as an intermediate product.

Advantageously, the gas forming during gasification is energetically utilized, preferably as an energy carrier, for the generation of vapor within the brewery system, e.g., as an additional gas to natural gas, so as to enable its energetic utilization by the brewery boiler plant through burning.

Preferably, supplementary drying aimed at eliminating capillary water by the aid of electric fields or by the aid of high-frequency fields is carried out for mechanically predrying the spent grains.

Mechanical predrying suitably is effected at least to a water content of 65 and, preferably, 62% by mass.

Suitably, solar energy may be additionally applied for the thermal drying of the mechanically predried spent grains.

The thermal drying of the spent grains advantageously is effected to a water content enabling autocombustion of the same, preferably at least to a water content of 55% by mass.

According to a preferred embodiment, pulp press water formed in mechanical predrying is treated anaerobically and the methane-containing gas formed is energetically utilized, preferably as an energy carrier for the generation of vapor within the brewery system.

Offgases forming in the combustion of the dried spent grains are disposed off along with offgases formed in a steam boiler of the brewery in a cost-effective manner.

According to a preferred variant, mixtures of spent grains and other organic biogenic waste substances are thermally utilized.

A plant for carrying out the process, comprising a mechanical drier constituting a first drying stage for spent grains and a thermal drier constituting a further drying stage for mechanically dehydrated spent grains as well as a device for thermal utilization by burning or gasifying the dried spent grains is characterized in that a duct carrying smoke gas off a steam boiler of the energy system of the brewery feeds into the thermal drier.

Preferably, the device for the thermal utilization of the spent grains comprises a combustion boiler, said combustion boiler suitably being equipped with a vapor generating means and said vapor generating means advantageously being coupled with the energy system of the brewery.

In an investment-saving manner, a smoke gas discharge duct issuing from the combustion boiler feeds into an offgas installation of a beer production plant, wherein, suitably, also an offgas duct from the thermal drier feeds into the offgas installation of the beer production plant.

According to a further preferred embodiment, the device for thermal utilization comprises a gasification means, wherein, suitably, a duct issuing from the gasification means and carrying off gases produced in the gasifier leads to a burner of a steam boiler of the energy system of the brewery.

The mechanical drier may preferably be configured as a travelling screen press or as a worm extruder.

A convection drier may suitably be employed as the thermal drier.

Preferably, the thermal drier comprises a drying means operable by solar energy.

According to a further advantageous embodiment, thermal drying, gasification and burning may be united in an apparative device, wherein, suitably, a duct carrying off the hot offgases from the device comprising thermal drying, gasification and burning is conducted directly to the steam boiler of the energy consumer of the brewery.

Thermal drying may be additionally extended by a drying means operable by solar energy.

In the following, the invention will be explained in more detail by way of two exemplary embodiments illustrated in the drawing, wherein FIGS. 1 and 2 each depict a process scheme according to a configuration variant.

At first, the wet spent grains 1 are adjusted to a water content ranging from about 65 to 62% by mass in a first drying stage 2 in a mechanical drier 3, which, according to FIG. 1, is designed as a worm press. Burning of the spent grains at such a water content is, however, not yet possible without back-up heating. For that reason, further drying is accomplished in a further drying stage 4, in which drying of the mechanically dehydrated spent grains 5 is carried out thermally.

To this end, a thermal drier 6 designed as a tumbling drier is provided, according to FIG. 1. The tumbling drier 6 is heated directly by smoke gas fed through duct 7 and coming from a boiler 10 installed in a beer production plant 8. The boiler 10 is heated by natural gas, which is supplied through duct 9; the vapor-conducting tubes are denoted by 11. A portion of the smoke gas may be supplied directly to an offgas blower 13 of the smoke gas disposal plant via a branch duct 12. The smoke gas duct 14 departing from the tumbling drier 6 also feeds into that smoke gas disposal plant.

By the aid of such thermal drying, it is feasible to lower the water content to below 55% by mass such that the spent grains 15 after ignition will bum automatically, i.e., without back-up heating. Burning of the dried spent grains 15 is effected by means of burners 16 in a combustion boiler 17 in which a vapor generating means 18 is installed. The vapor generated in that vapor generating means 18 is practically used for the production of beer, i.e., natural gas for the natural gas burner 19 in the natural-gas-fired boiler 10 may be saved. Ash discharging is denoted by 20.

Figure 2:
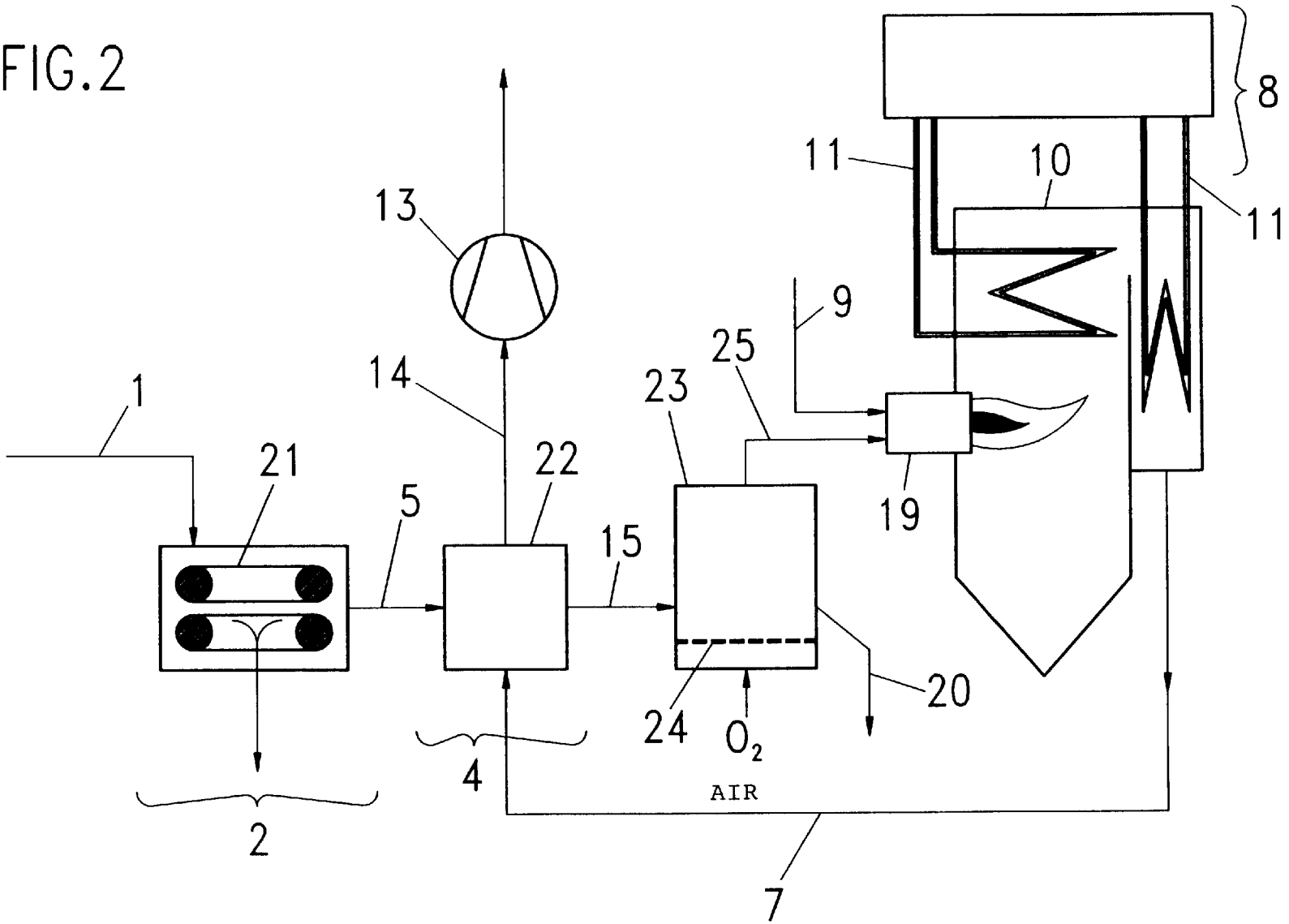

According to the embodiment represented in FIG. 2, the wet spent grains 1 initially are subjected to mechanical drying in a first drying stage 2 by means of a screen belt press 21.

After this, the mechanically dehydrated spent grains are supplied to a thermal drier of the second drying stage 4, which is designed as a convection drier 22 and in which the spent grains 5 are dried to a water content of below the autoburning limit by the aid of smoke gas derived from a beer production plant 8, as in accordance with FIG. 1.

According to FIG. 2, the thermal utilization of the dry spent grains 15 is realized in a gasifier 23, which is fed with oxygen or an oxygen-containing gas such as air, via a sieve plate 24. Ash discharging is denoted by 20.

The gases ($CO$, $H_2$, $CO_2$, $N_2$) forming within the gasifier 23 are readily burnable and, being burning gases, may substitute for a part of the natural gas used in the beer production plant; they are fed to the natural-gas burner 19 via duct 25. The advantage of this technique as compared to combustion resides in that no additional solids combustion boiler need to be arranged and that the nitrogen and sulphur oxides forming during combustion are avoided. A gas essentially consisting of carbon monoxide, carbon dioxide, hydrogen and molecular nitrogen will form during gasification.

In order to reduce or eliminate the capillary water contained in the spent grains, other drying procedures may also be applied in addition to mechanical and thermal drying, for instance drying by the aid of high-frequency fields or electromagnetic fields. Natural energy such as solar energy may also be applied for assisting in thermal drying, solar energy being fed before or after the thermal drying stage 4—depending on the dew point of the smoke gas.

EXAMPLE

In a brewery with an annual output of about 1.2 million hectoliters of beer, about 24,000 tons of spent grains 1 having a water content of about 80% by mass occur per year. The spent grains 1 obtained are predried mechanically to a water content of about 62% by mass by means of a press (e.g., worm press 3). An amount of 24,000 tons of wet spent grains, which are mechanically dehydrated to a water content of 62% by mass, yields 11,370 tons of pulp press water/year. Hence results a load by waste water of 113,700 kg CSB/year. The pulp press water 26 forming advantageously is supplied to anaerobic water purification—which is not illustrated in detail in the Figures -, where a burnable gas containing methane is recovered. From the amount of pulp press water mentioned, about 36,400 $m^3$ biogas/year are formed. By burning that gas containing 85% methane, about 300,000 kWh/year are obtained; this constitutes additional proceeds. The water content of the spent grains 5 is about 62% by mass after mechanical drying. In order to ensure autoburnability, a value of 55% by mass of water is to be attained.

In order to further lower the water content, alternative drying methods as described above may be used for reducing the capillary water. This may be achieved by water transportation within an electric field (electroosmosis) or powering with high-frequency fields for mobilizing a portion of the bound water, which may subsequently be made accessible to further mechanical pressing.

Depending on the efficacy of the alternative drying methods, thermal drying to a more or less large extent is subsequently effected in order to attain the degree of autoburning. The mechanically and alternatively predried spent grains 5 via a buffer vessel are continuously conveyed into a directly heated drier (e.g., tumbling drier 6) and convectionally dried at least to the autoburning degree of about 55% by mass of water by means of the 140 to 160° C. hot smoke gases derived from natural gas combustion.

The dried stock 15 is then supplied to a combustion tank 17 for biogenic waste and burned. The calorific value of spent grains is a linear function of the water content, lying at 55% by mass of water at about 7.68 MJ/kg. By burning one ton of spent grains, about 190 $m^3$ natural gas may, thus, be substituted for. In total, 4.5 million $Nm^3$ natural gas/year are required in a brewery of the size mentioned. From this, 2 million $m^3$ natural gas/year may be substituted for by spent grain burning, which is more than one third.

High nitrogen oxide emissions were expected during the combustion of spent grains 15 due to its high nitrogen content. In tests carried out with spent grains in special combustion boilers for sawdust, only 10% of the expected theoretically possible nitrogen oxide values could, however, be determined.

By a suitable process control during combustion (low combustion temperatures), $NO_x$ emissions may be minimized. Another problem is constituted by the sulphur dioxide forming during combustion. By introducing into a smoke gas purification plant, spent grain combustion gases along with the smoke gases obtained from natural gas burning, compliance with the limit values in regard to tanks for the combustion of biogenic wastes may be ensured. Likewise, the CO value may be controlled by adjustment of the λ value, thereby enabling optimization between $NO_x$ and CO values. Another approach towards $NO_x$ reduction is, for instance, by nozzling in $NH_3$.

The invention is not limited to the above-described examples, but may be modified in various aspects. Thus, drying of the wet spent grains may be accomplished by any desired number of drying stages, it being, however, essential that at least one mechanical drying stage 2 and at least one thermal drying stage 4 be included. Furthermore, combined apparative configurations of thermal predrying, gasification and burning are feasible, which likewise will meet the criteria set out above.

The process according to the invention may be extended to the extent that, in addition to spent grains, also other biogenic wastes, such as sewage sludge, may be encompassed by the process in order to be able to increase the energy content and hence the formation of vapor. The treatment of the mixture of spent grains and other biogenic wastes is effected in the same manner as explained in the description of the process.

What is claimed is:

1. A process for thermally utilizing wet spent grains (1), wherein the wet spent grains (1) are mechanically predried in a first drying stage (2), thermally dried in a further drying stage (4) and finally thermally utilized by burning or gasification, characterized in that the mechanically dehydrated spent grains (15), in the further drying stage (4), are heated by the aid of a smoke gas occurring within the energy system of a brewery.

2. A process according to claim 1, characterized in that the smoke gas occurring in the brewery is formed by the combustion of natural gas for the purpose of generating vapor.

3. A process according to claim 1, characterized in that the gas forming during the gasification of spent grains is energetically utilized, preferably used as an energy carrier for the generation of vapor within the brewery system.

4. A process according to claim 1, characterized in that supplementary drying aimed at eliminating capillary water by the aid of electric fields is carried out for mechanically predrying the spent grains.

5. A process according to claim 1, characterized in that supplementary drying aimed at eliminating capillary water by the aid of high-frequency fields is carried out for mechanically predrying the spent grains (1).

6. A process according to claim 1, characterized in that mechanical predrying of the spent grains is effected at least to a water content of 65% by mass.

7. A process according to claim 1, characterized in that solar energy is additionally applied for the thermal drying of the mechanically predried spent grains (5).

8. A process according to claim 1, characterized in that, in the further drying stage (4), the spent grains (5) are dried to a water content enabling autocombustion of the same.

9. A process according to claim 1, characterized in that pulp press water formed in mechanical predrying is treated anaerobically and the methane-containing gas formed thereby is energetically utilized, preferably as an energy carrier for the generation of vapor within the brewery system.

10. A process according to claim 1, characterized in that offgases forming in the combustion of the dried spent grains (15) are carried off along with offgases formed in a steam boiler of the brewery.

11. A process according to claim 1, characterized in that mixtures of spent grains and other organic biogenic waste substances are thermally utilized.

12. A plant for carrying out the process according to claim 1, comprising a mechanical drier (3; 21) constituting a first drying stage (2) for spent grains (1) and a thermal drier (6; 22) constituting a further drying stage (4) for mechanically dehydrated spent grains (5) as well as a device (17; 23) for thermal utilization by burning or gasifying the dried spent grains (15), characterized in that a duct (7) carrying smoke gas off a steam boiler of the energy system of the brewery feeds into the thermal drier (6; 22).

13. A plant according to claim 12, characterized in that the device for the thermal utilization of the spent grains comprises a combustion boiler (17).

14. A plant according to claim 13, characterized in that the combustion boiler (17) is equipped with a vapor generating means (18).

15. A plant according to claim 14, characterized in that the vapor generating means (18) is coupled with the energy system of the brewery.

16. A plant according to claim 13, characterized in that a smoke gas discharge duct issuing from the combustion boiler (17) feeds into an offgas installation of a beer production plant (8).

17. A plant according to claim 16, characterized in that an offgas duct (14) from the thermal drier (6) feeds into the offgas installation of the beer production plant (8).

18. A plant according to claim 12, characterized in that the device for thermal utilization comprises a gasification means (23).

19. A plant according to claim 18, characterized in that a duct (25) issuing from the gasification means (23) and carrying off gases produced in the gasifier leads to a burner (9) of a steam boiler of the energy system of the brewery (8).

20. A plant according to claim 12, characterized in that the mechanical drier comprises a travelling screen press (21).

21. A plant according to claim 12, characterized in that the mechanical drier comprises a worm extruder (3).

22. A plant according to claim 12, characterized in that the thermal drier comprises a convection drier (22).

23. A plant according to claim 12, characterized in that the thermal drier comprises a drying means operable by solar energy.

24. A plant according to claim 12, characterized in that thermal drying, gasification and burning is united in an apparative device.

25. A plant according to claim 24, characterized in that a duct carrying off the hot offgases from the device comprising thermal drying, gasification and burning is conducted directly to the steam boiler of the energy consumer of the brewery.

* * * * *